US011154963B2

(12) United States Patent
Panzenhagen et al.

(10) Patent No.: US 11,154,963 B2
(45) Date of Patent: Oct. 26, 2021

(54) TWIST-LOCK ASSEMBLY FOR A CENTRIFUGAL BLASTING WHEEL

(71) Applicant: CP Metcast, Inc., New Berlin, WI (US)

(72) Inventors: Carl P. Panzenhagen, New Berlin, WI (US); Arnold A. Chamberlain, III, Cudahy, WI (US)

( * ) Notice: Subject to any disclaimer, the term of this patent is extended or adjusted under 35 U.S.C. 154(b) by 763 days.

(21) Appl. No.: 15/435,662

(22) Filed: Feb. 17, 2017

(65) Prior Publication Data

US 2017/0239786 A1 Aug. 24, 2017

Related U.S. Application Data

(60) Provisional application No. 62/296,813, filed on Feb. 18, 2016.

(51) Int. Cl.
*B24C 5/06* (2006.01)

(52) U.S. Cl.
CPC ..... *B24C 5/066* (2013.01); *B24C 5/06* (2013.01); *B24C 5/068* (2013.01)

(58) Field of Classification Search
CPC ..... B24C 5/06; B24C 5/062; B24C 5/064; B24C 5/066; B24C 5/068; F16L 37/107; F16L 37/113
See application file for complete search history.

(56) References Cited

U.S. PATENT DOCUMENTS

| | | | | |
|---|---|---|---|---|
| 2,165,163 A * | 7/1939 | Waters | F16L 37/113 285/361 |
| 3,768,209 A * | 10/1973 | Punter | B24C 5/06 241/275 |
| 4,395,851 A * | 8/1983 | Watts | B24C 5/06 451/97 |
| 2003/0107218 A1* | 6/2003 | Anderson | B60K 15/04 285/360 |

* cited by examiner

*Primary Examiner* — Orlando E Aviles
*Assistant Examiner* — Joel D Crandall
(74) *Attorney, Agent, or Firm* — Wozny IP Law; Thomas M. Wozny

(57) ABSTRACT

A twist-lock assembly for locking and unlocking a feed spout and control cage in their respective operative positions on a centrifugal blasting wheel. The twist-lock assembly includes a stationary control cage adapter and a rotatable clamping plate. The control cage adapter is mounted on a side wall of the centrifugal blasting wheel housing and located at an access opening in the housing. The clamping plate is rotatable with respect to the control cage adapter for locking and unlocking the control cage and the feed spout in their respective operative positions in response to rotation thereof between a clockwise locking position and a counterclockwise unlocking position. The result is an improved assembly for quickly dis-connecting and re-connecting the feed spout and control cage to provide ease of maintenance.

16 Claims, 16 Drawing Sheets

TWIST-LOCK ASSEMBLY FOR A CENTRIFUGAL BLASTING WHEEL

BACKGROUND OF THE INVENTION

The present invention relates to centrifugal throwing wheels, sometimes referred to as centrifugal blasting wheels or centrifugal shotblast wheels, used to project streams of abrasive particles against a workpiece to subject the surface of the workpiece to cleaning or abrading action. More specifically, the present invention relates to a twist-lock assembly for locking and unlocking a feed spout and control cage in their respective operative positions in a centrifugal blasting wheel.

Installations equipped with centrifugal blasting wheels are typically used to remove scale or rust from the surface of metallic workpieces, or to clean the surface of metal castings. Centrifugal blasting wheels will typically employ a throwing wheel assembly having a plurality of radially extending throwing blades mounted on a rotatable wheel. The throwing blades are positioned to receive a stream of abrasive particulate material, sometimes referred to as blasting shot, and then throw the particulate material radially outwardly from the wheel at an appropriate discharge location. An impeller rotates within a stationary control cage, and is used to receive the blasting shot from a feed spout, and distribute the blasting shot through a discharge slot in the control cage to the rotating throwing blades.

Due to the action of the abrasive blasting shot, numerous components of the blasting wheel are subjected to extensive wear over time. For example, the throwing blades must be periodically removed and replaced. In most centrifugal blasting machines, such periodic blade removal and replacement requires disassembly of numerous components such as the feed spout, impeller, and control cage before the blades can be accessed for removal and replacement. Such a procedure can be very time consuming, especially when minute abrasive particulate or dust work its way into crevices to cause "shot locking" or seizing of these parts. As a result, valuable operating time may be lost. Further, when the blades are removed and replaced, or when the abrasive particulate material being used needs to be changed to a different type of abrasive particulate material, the control cage, upon re-assembly to its operative position, needs to be reset or re-aligned to its original position so that its discharge slot is properly located to distribute the blasting shot from the impeller to the blades.

As a result, there exists a need for an improved assembly for quickly disconnecting and re-connecting the feed spout and control cage of a centrifugal blasting machine to provide ease of maintenance.

There also exists a need for an improved alignment technique for the control cage to eliminate cage misalignment when the cage is re-assembled to its operative position after equipment change-outs or repairs.

SUMMARY OF THE INVENTION

The present invention provides a twist-lock assembly for locking and unlocking a feed spout and control cage in their respective operative positions on a centrifugal blasting wheel. The present invention also provides alignment mechanisms to ensure the blasting wheel is re-assembled with all components in their correct and original orientation after equipment change-outs or repairs. The result is an improved assembly for quickly dis-connecting and re-connecting the feed spout and control cage to provide ease of maintenance.

There is thus provided an improved twist-lock assembly for permitting quick disassembly and reassembly of the feed spout and control cage of a centrifugal throwing wheel. More specifically, in one aspect, the invention provides a centrifugal throwing wheel for propelling abrasive shot blast material against a workpiece, comprising:

(a) a housing having an access opening in one side wall thereof;

(b) a throwing wheel rotatable within the housing;

(c) a plurality of throwing blades disposed within the housing that are removably coupled to the throwing wheel;

(d) a control cage supported within the housing at the access opening and disposed in a stationary operative position relative to the throwing wheel;

(e) an impeller within the housing coupled to the throwing wheel for rotation within the control cage;

(f) a feed spout removably mounted on the side wall of the housing and disposed at the access opening of the housing, said feed spout having a shot-receiving inlet end and a shot-discharging exit end aligned with the impeller for delivering blasting shot to the impeller; and (g) a twist-lock assembly for locking and unlocking the feed spout and control cage in their respective operative positions, said twist-lock assembly comprising:

(i) a control cage adapter mounted on the side wall of the housing at the access opening; and (ii) a clamping plate rotatable with respect to the control cage adapter for locking and unlocking the control cage and the feed spout in their respective operative positions in response to rotation thereof between a locking position and an unlocking position.

In another aspect, the control cage of the centrifugal throwing wheel includes a pair of tenons projecting therefrom, and the control cage adapter includes a corresponding pair of mortises or channels formed therein. The mortises or channels of the control cage adapter slidably receive the tenons of the control cage during assembly, and thereby properly align the control cage with respect to the control cage adapter to prevent misalignment of the control cage.

DETAILED DESCRIPTION OF THE PREFERRED EMBODIMENTS OF THE INVENTION

Figure 1:
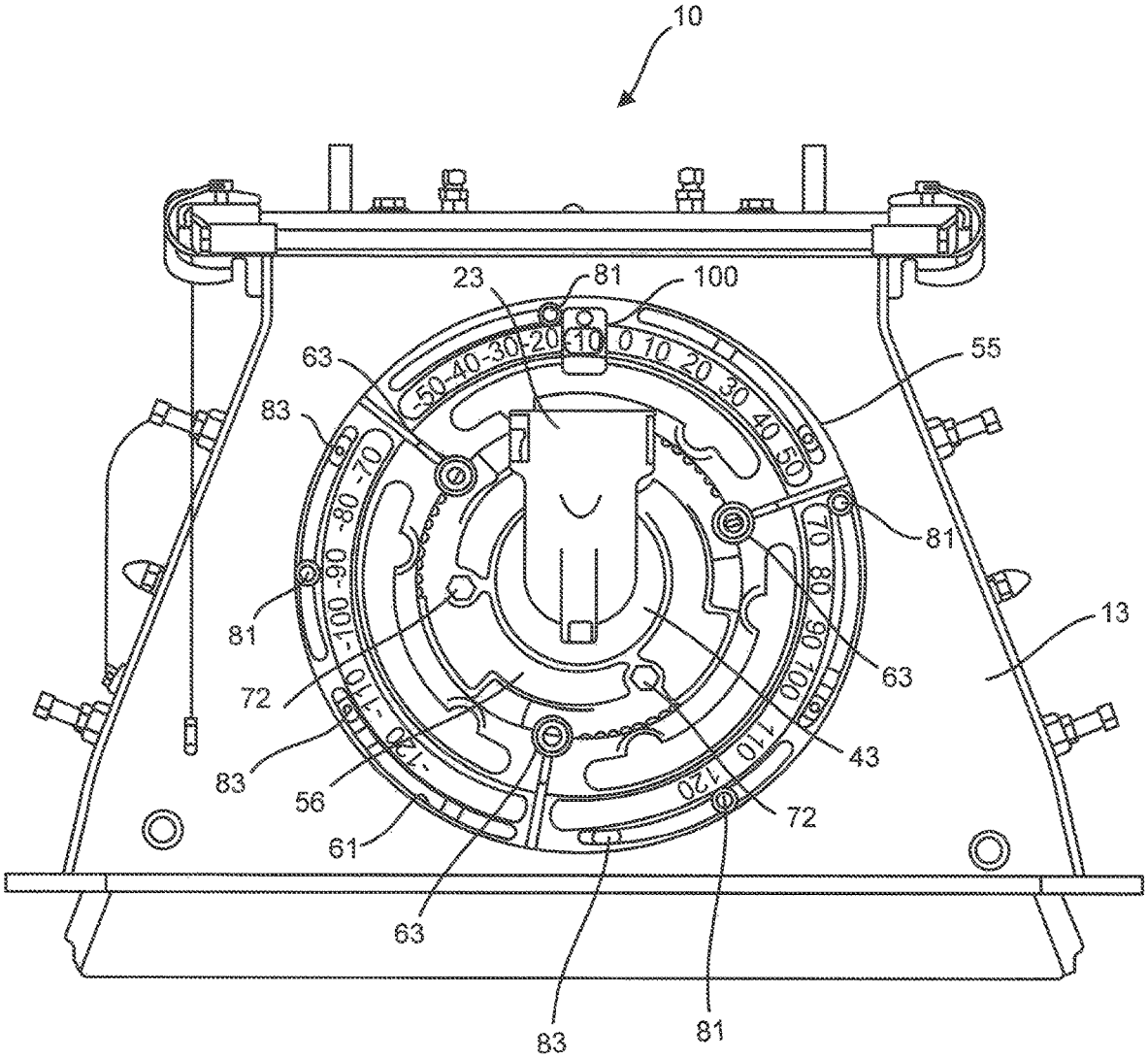
FIG. 1 is an end view in elevation of a centrifugal blasting wheel incorporating a twist-lock assembly and a control cage alignment mechanism of the present invention.
Figure 2:
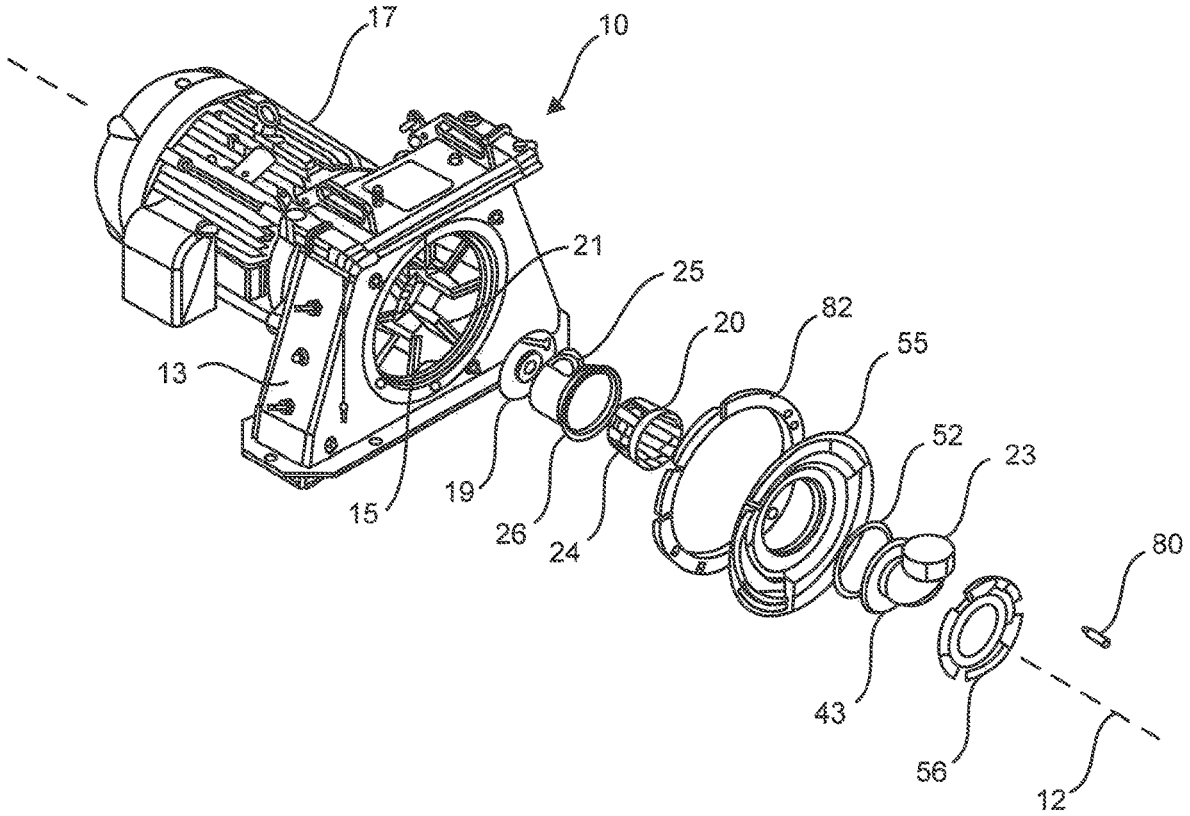
FIG. 2 is an exploded perspective view illustrating the various components of the centrifugal blasting wheel of FIG. 1.
Figure 3:
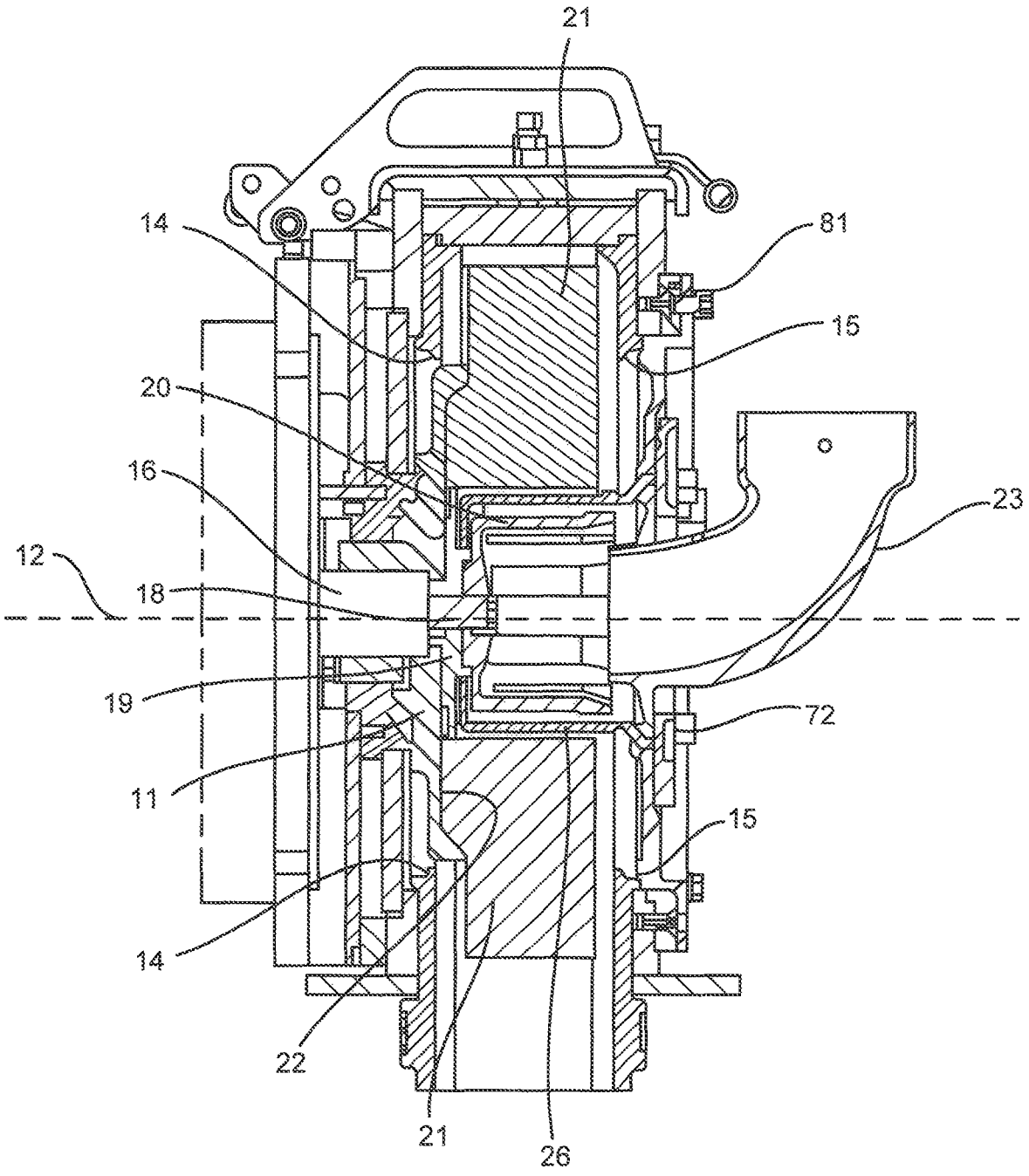
FIG. 3 is a sectional side view in elevation of the centrifugal blasting wheel of FIGS. 1 and 2.

Referring to FIGS. 1-3, there is illustrated a centrifugal blasting wheel assembly, generally designated by the number 10, incorporating a twist-lock assembly and alignment mechanisms constructed in accordance with the present invention. The blasting wheel assembly 10 includes a rotatable throwing wheel 11 having an axis of rotation 12. The throwing wheel 11 is supported for rotation within a housing 13 having a driveshaft-receiving opening 14 in one side wall thereof, and an access opening 15 in an opposite side wall thereof. Openings 14 and 15 are disposed concentrically with each other as well as with rotational axis 12. A dive shaft 16 is disposed concentrically with openings 14 and 15, and has an axis of rotation that is coaxial with rotational axis 12. Drive shaft 16 also has an outer end disposed at the opening 14 of housing 13, and an inner end connected to a source of power, such as motor 17, for rotating the drive shaft 16 to thereby transmit power to throwing wheel 11. As shown best in FIG. 3, throwing wheel 11 is connected to the outer end of drive shaft 16 via a bolt 18. A hub 19 is also affixed via bolt 18 to throwing wheel 11 for rotation therewith. An impeller 20 is centrally mounted to hub 19, also via bolt 18, for rotation with hub 20 and throwing wheel 14 so that drive shaft 16, hub 19 and impeller 20 all rotate in unison along rotational axis 12.

A plurality of rotating throwing blades 21 are removably mounted on, and are generally perpendicular to, inner face 22 of throwing wheel 11. The impeller 20 receives a stream of abrasive particulate blasting material, typically referred to as blasting shot, from a feed spout 23, and in turn feeds the blasting shot to the throwing blades 21. The impeller 20 is provided with a plurality of openings 24 for delivering the blasting shot through a discharge slot 25 provided in a stationary control cage 26 that surrounds the impeller 20 and in which the impeller 20 rotates. The blasting shot is thereby received at the inlet ends of the throwing blades 21 as the blades 21 rotate past the discharge slot 25 of control cage 26. The blasting shot is then accelerated as it moves radially outwardly along the surface of the throwing blades 21 until it is thrown from the distal end of the blades 21 at a desired discharge point against the surface of a workpiece.

Figure 4:
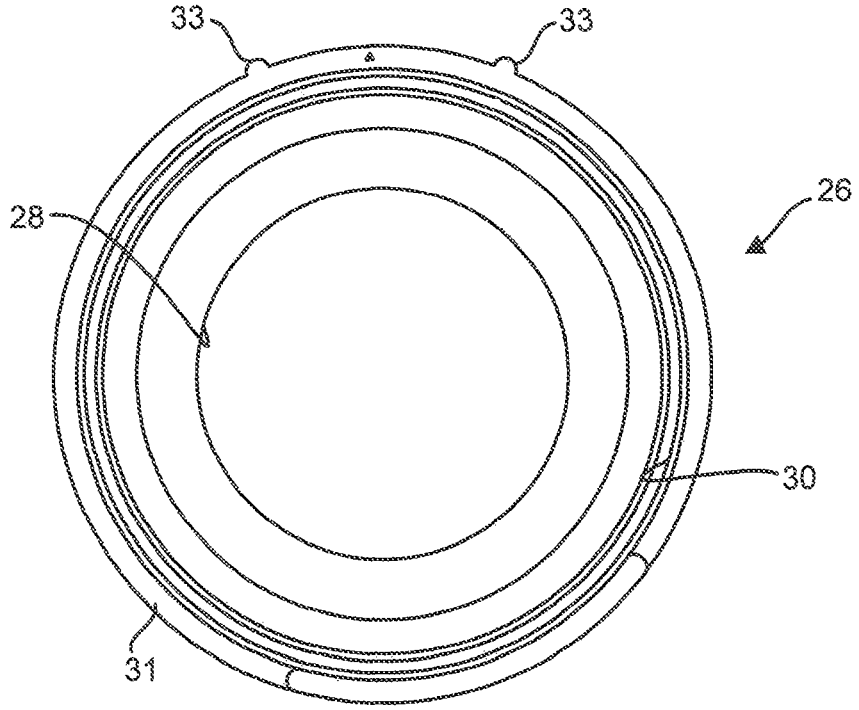
FIG. 4 is an end view in elevation of a control cage for the centrifugal blasting wheel looking into the interior thereof.
Figure 5:
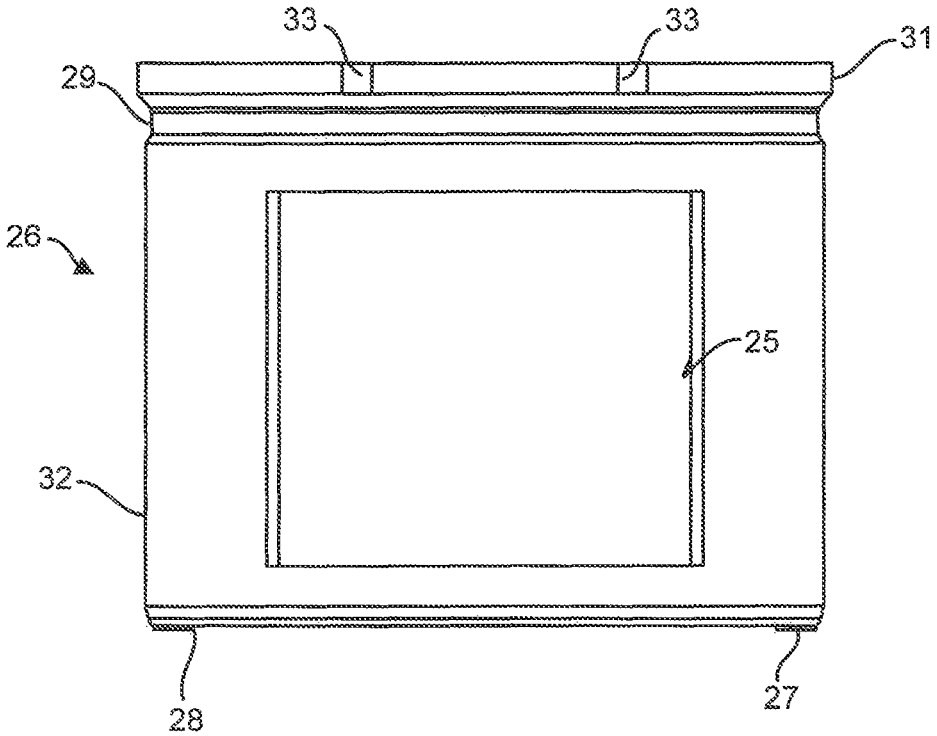
FIG. 5 is a side view in elevation of the control cage.
Figure 6:
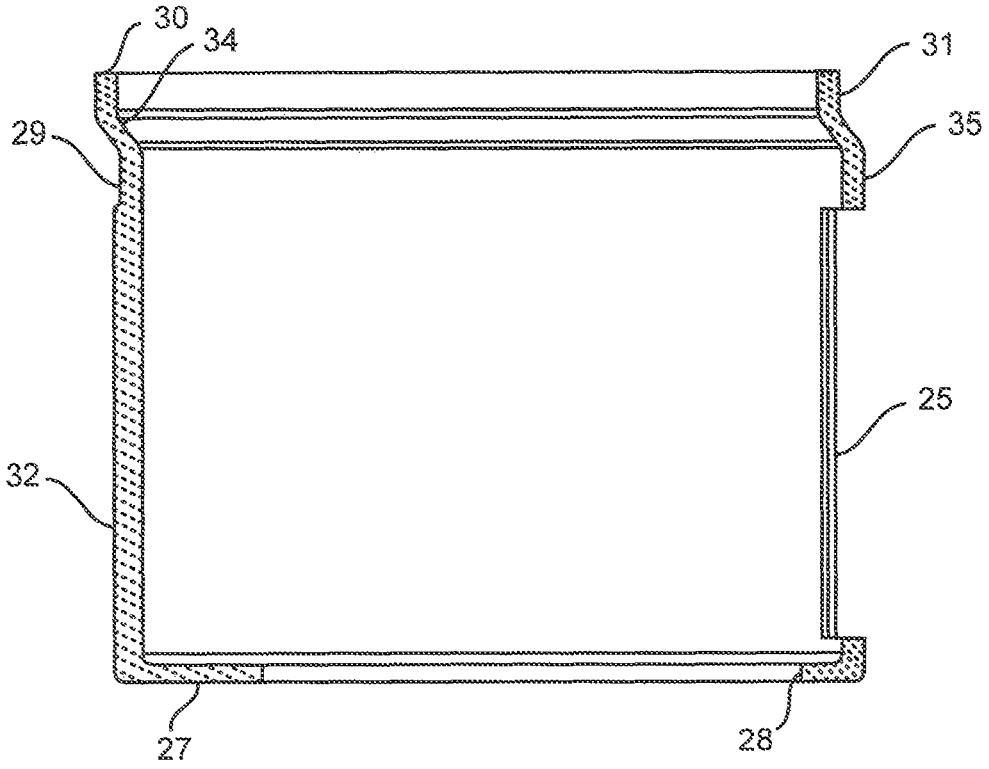
FIG. 6 is a sectional view of the control cage of FIG. 4.
Figure 16:
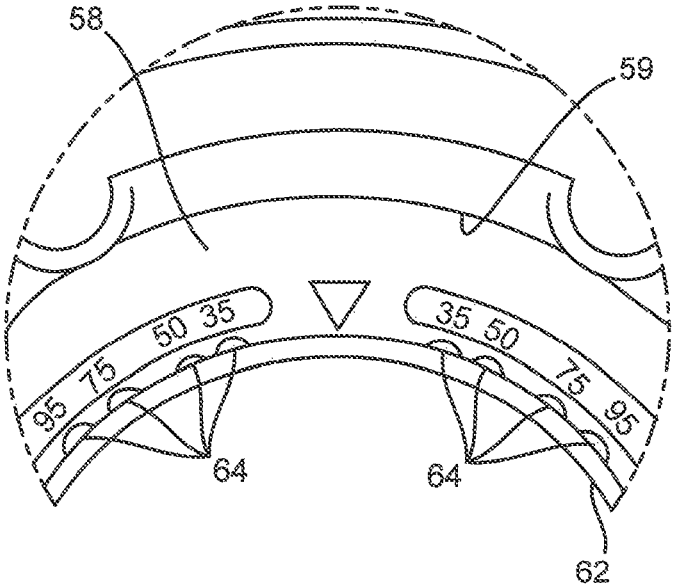
FIG. 16 is an enlarged partial end view of the channels.

Turning now to FIGS. 4-7, the control cage 26 is illustrated in more detail. In general, control cage 26 is in the shape of a cylinder with one end partially closed and its other end completely open. Control cage 26 thus has an annular base plate 27 that extends substantially perpendicularly to the axis of rotation 12. Base plate 27 thus has an inner opening 28 defining a circumferential surface that is radially spaced from hub 19 and impeller 20 in order to accommodate rotation of hub 19 and impeller 20 within cage 26. Cage 26 also has a cylindrically shaped outer wall 29 that extends axially from the outer circumferential edge of base plate 27 toward the access opening 15 in housing 13. Outer wall 29 thus defines an inner surface 34, an outer surface 35, and an outer opening 30 having an L-shaped rim 31 disposed within access opening 15 of housing 13. By "L-shaped" it is meant that the legs of the "L" may form a right angle, i.e. a 90 degree angle, or an obtuse angle, i.e. an angle exceeding 90 degrees but less than 180 degrees. As illustrated in FIG. 6, the preferred angle formed by the legs of the "L" is about 135 degrees. As shown best in FIG. 5, control cage 26 also includes a substantially rectangular shaped discharge opening or slot 25 formed in outer wall 29. Discharge opening or slot 25 receives blasting shot from impeller 20 and feeds it to throwing blades 21, as previously described herein. The position of opening 25 within housing 13 and with respect to blades 21 is critical to proper operation of blasting wheel 10. Opening 25 of cage 26 should preferably face upwardly, either vertically or at an acute angle to vertical, when cage 26 is assembled in its operational position (as best shown in FIGS. 2, 3 and 16) within housing 13. The dimensions of opening 25, especially its width, is also critical for proper operation, as a change in the size or dimensions of opening 25 will result in a corresponding change in the pattern of the blasting shot exiting wheel 10, as is well known in this art.

As illustrated in FIG. 6, control cage 26 includes a wear ring 32 disposed along the outer surface 35 of outer wall 29. Wear ring 32 extends from base plate 27 to a location spaced axially inwardly from rim 26. Wear ring 32 has a thickness which is greater than outer wall 29, and is located along the high wear zone of the cage 26, and thus extends the life of cage 26.

Figure 7:
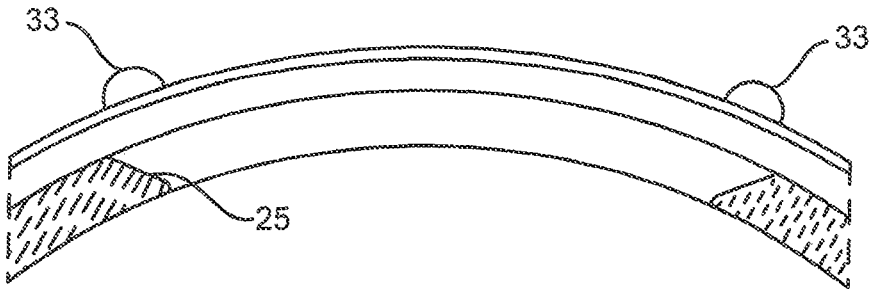
FIG. 7 is an enlarged partial sectional view illustrating a pair of tenons projecting from the control cage forming part of the alignment mechanism for the control cage.
Figure 8:
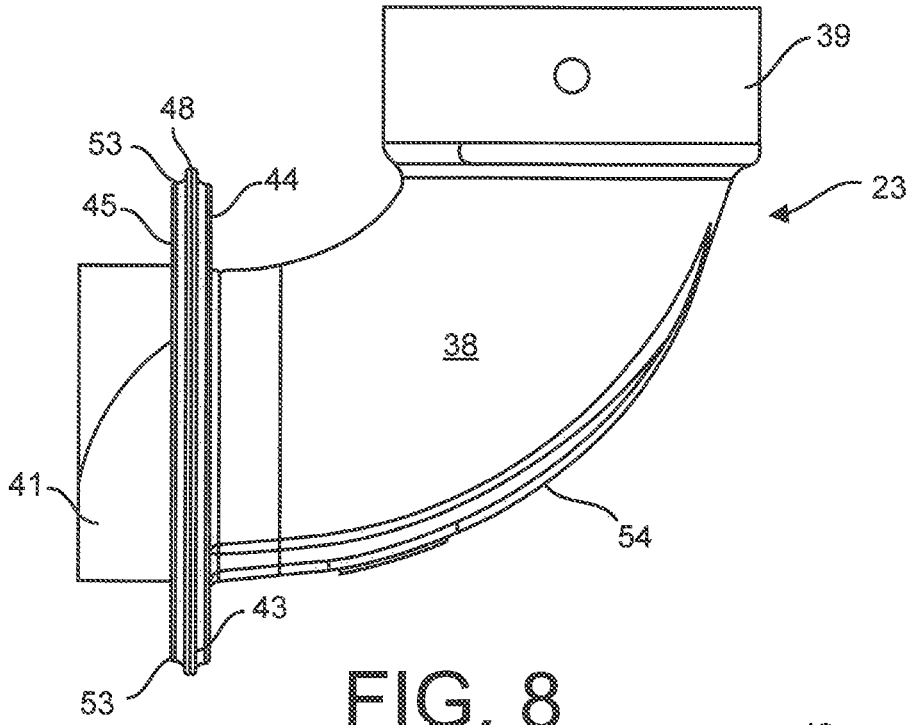
FIG. 8 is a side view in elevation of a feed spout for the centrifugal blasting wheel.

As shown in FIGS. 4, 5 and 7, control cage 26 also includes an arrangement for properly aligning it within housing 13 so that discharge opening 25 faces upwardly when cage 26 is installed within housing 13, as shown best in FIG. 2. More specifically, a pair of spaced tenons 33 project outwardly from the surface 35 of rim 31. Tenons 33 are circumferentially spaced a predetermined arcuate distance from each other along rim 31, and as shown in FIGS. 5 and 7, are preferably located in positions which are axially aligned with the opposite edges of discharge opening 25.

Each tenon 33 has a longitudinal center extending axially along the outer surface 35 of rim 31, and has a cross section which is in the form of one-half a cylinder, i.e. a cylinder which has been bisected by a plane extending longitudinally through its center, i.e. bisected perpendicular to the base of the cylinder. Thus, the cross section of each tenon 33 is one-half of acylinder, and that one-half being the longitudinally extending half of the cylinder. As noted, tenons 33 are circumferentially spaced from each other a predetermined distance, and are preferably aligned with the opposite edges of opening 25. Thus, when desiring to change the pattern of the blasting shot exiting wheel 10, a different cage 26 having a different size opening 25 must be used. A different cage 26 having a different size opening 25 will in turn change the circumferential spacing or arcuate distance between tenons 33 to be either greater or lesser. As will hereinafter be described with respect to FIG. 16, there is only one pair of channels 64 in control cage adapter 55 that have the identical circumferential or arcuate spacing. Thus, for each different size opening 25, control cage 26 can only be installed in one position which position ensures the opening 25 for that particular cage 26 being installed is positioned upwardly no matter the dimensions or size of opening 25.

Turning now to FIGS. 8-11, the feed spout 23 is illustrated in more detail. Feed spout 23 includes a cylindrically-shaped body 38 having an inlet end 39 defining a circular inlet opening 40 for receiving blasting shot, and an exit end 41 defining a circular exit opening 42 for feeding blasting shot to impeller 20. Body 38 is arcuate-shaped in length such that a line running through the center of inlet opening 39 is perpendicular to a line running through the center of exit opening 40 and thus forms a 90 degree angle therewith. Body 38 forms an integral female coupling at inlet end 39 for receiving the end of a flexible tube (not shown) that conveys blasting shot to the feed spout 23. Body 38 also includes an integral radially extending mounting flange 43 at exit end 41 for mounting spout 23 to housing 13, as will hereinafter be described.

Figure 11:
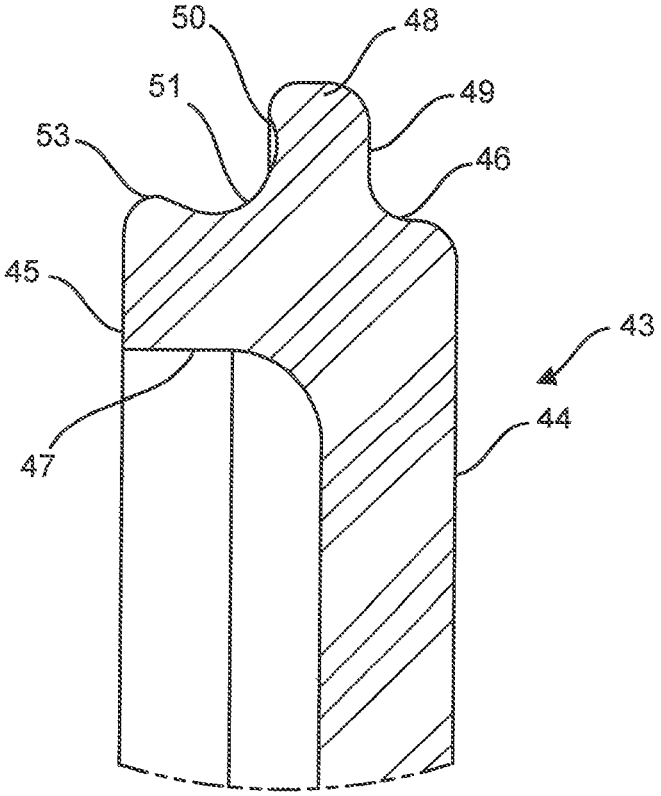
FIG. 11 is an enlarged partial sectional view of the outer end of a mounting flange on the feed spout of FIG. 9.

As shown best in FIG. 11, flange 43 has an outer planar surface 44, an opposite inner planar surface 45 disposed parallel to outer surface 44, and a circumferential surface 46. An annular recess 47 is formed in inner surface 45 so that inner surface 45 is in the shape of an annular ring when viewed endwise. An annular rim 48 is integrally formed on surface 46, and projects radially therefrom. Rim 48 has an outer surface 49 integrally formed and contiguous with outer surface 44 and circumferential surface 46 of flange 43 as well as an inner surface 50 integrally formed and contiguous with inner surface 45 and circumferential surface 46 of flange 43. The transition from circumferential surface 46 to outer surface 49 of rim 48 is arcuate-shaped to provide strength for rim 48. The transition from circumferential surface 46 to inner surface 50 of rim 48 is also arcuate-shaped and forms a seal-receiving recess 51 for receiving a rubber O-ring type seal 52. As shown best in FIGS. 2 and 3, seal 52 functions to tightly seal feed spout 23 against the L-shaped rim 31 of control cage 26 to prevent the passage of, or the escape of, blasting shot and/or blasting shot dust from impeller 20 and control cage 26. Seal 52 is held within recess 51 by a circular lip 53 formed on circumferential surface 46 adjacent the inner surface 45 of flange 43. Lip 53 projects radially from surface 46 such that its apex has a diameter slightly greater than the inner diameter of the O-ring seal 52. This requires O-ring seal 52 to be stretched outwardly until it can be rolled over lip 53 into recess 51 where it contracts and is held in place. As a result, when feed spout 23 is removed from housing 13, the O-ring seal 52 remains in place on flange 43 of spout 23. This provides ease of replacement of the O-ring seal 52, if necessary, and also for easy re-assembling of feed spout 23 to housing 13 after any required maintenance of machine 10 because O-ring seal 52 does not need to be re-positioned and held in place while also trying to simultaneously mount feed spout 23 on housing 13.

Figure 10:
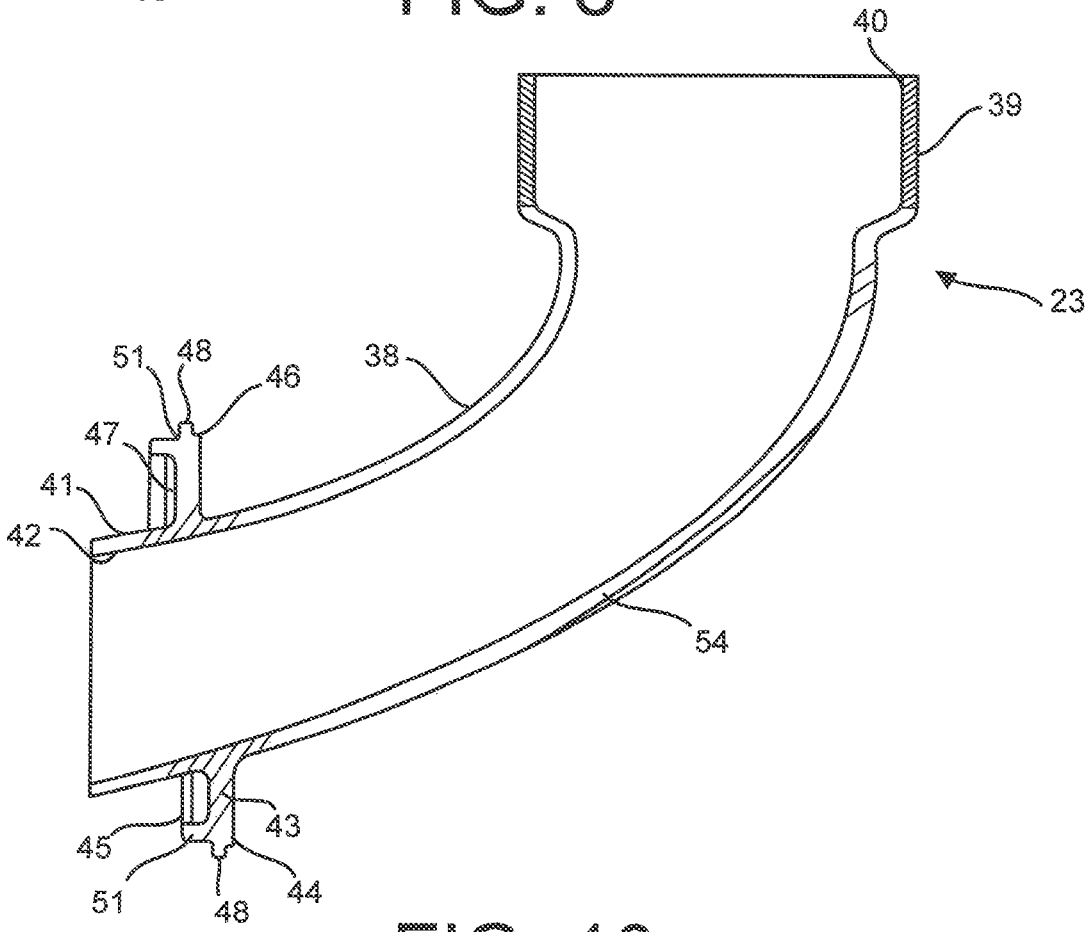
FIG. 10 is a sectional view of the feed spout of FIG. 9.
Figure 9:
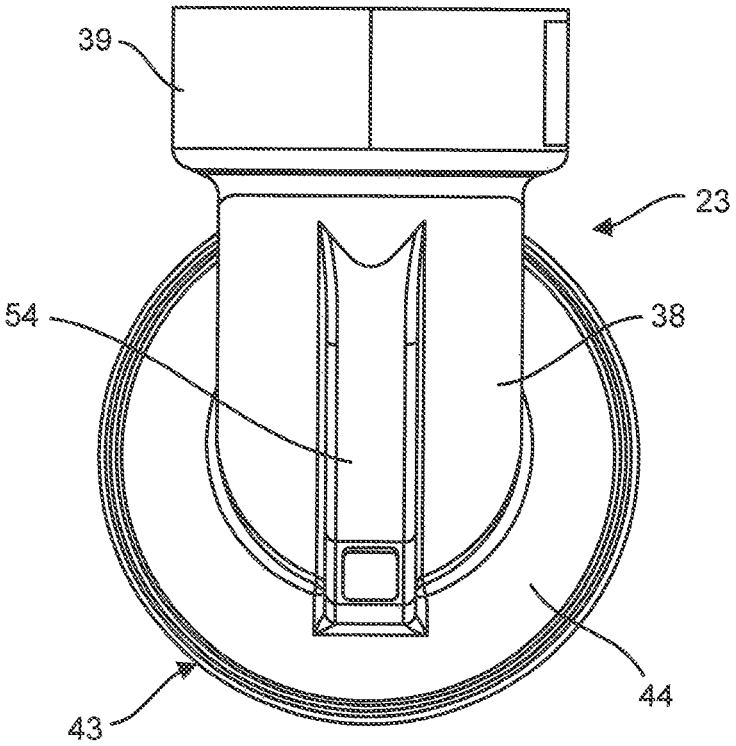
FIG. 9 is an end view of the feed spout.

As shown best in FIGS. 9 and 10, the body 38 of feed spout 23 has an integral reinforcing rib 54 extending along its lower side from the inlet end 39 to the exit end 41. Rib 54 functions to strengthen the lower end of spout 23 against the pounding force and the wear action of blasting shot being conveyed thereto dropping through inlet opening 40 and against the lower inner surface thereof. Rib 54 thus extends the life of feed spout 23, and thus helps prevent premature replacement of feed spout 23.

Turning now to FIGS. 12-16, and FIGS. 17-19, there is illustrated a twist-lock assembly comprised of a fixed control cage adapter 55 and a rotatable clamping plate 56 for locking and unlocking the feed spout 23 and control cage 26 in their respective operative positions. The assembled operative positions for feed spout 23 and control cage 26 are best illustrated in FIG. 3. When properly assembled, O-ring seal 52 is compressed against the L-shaped rim 31 of control cage 26, and rim 31 in turn is forced against control cage adapter 55, by the clockwise twisting or rotational action of clamping plate 56 against adapter 55, as will hereinafter be described, to lock or hold both the feed spout 23 and control cage 26 in their assembled and operative positions.

Referring now to FIGS. 12-16, the control cage adapter 55 is illustrated in more detail. Adapter 55 includes an annular body comprised of an outer annular flat ring member 57 and an inner annular flat ring member 58 disposed in a plane parallel to, but spaced from, the plane of the outer flat ring member 57. Inner ring member 58 is thus offset with respect to outer ring member 59, and defines a circular recess 59 as well as a central opening 60 which is concentric with openings 14 and 15 in housing 13 and coaxial with rotational axis 12 when adapter 55 is mounted to housing 13 in its fixed operative position. Outer ring member 57 includes a plurality of circumferentially extending arcuate-shaped slots 61 formed therein through which a plurality of bolts 81 extend (see FIG. 1) to securely mount adapter 55 in a fixed location with respect to housing 13. This is accomplished by using a mounting ring 82. Mounting ring 82 is first attached to housing 13 using bolts 83, and then adapter 55 in turn is attached to mounting ring 82 using bolts 81. Inner ring member 58 includes a circular lip 62 formed around opening 60 which projects both radially inwardly and axially inwardly into opening 60 at approximately a 45 degree angle. Lip 62 functions to receive the L-shaped rim 31 of control cage 26, as previously described herein, during assembly of cage 26 within housing 13. A plurality of hollow sockets 63 project axially from the surface of outer ring member 57 along the circular edge of recess 59. Sockets 63 are equi-angularly spaced 120 degrees from each other about the edge of recess 59. Each socket 63 has a flat outer surface 65 and an opposite tapered inner surface 66 which is axially spaced from the surface of recess 59 (see FIGS. 13 and 14) a sufficient distance or length in order to accommodate the thickness of clamping plate 56. Although three sockets 63 are illustrated as preferred, a fewer number or a greater number could be employed depending upon the degree of sealing force desired, as will hereinafter be described.

Figure 12:
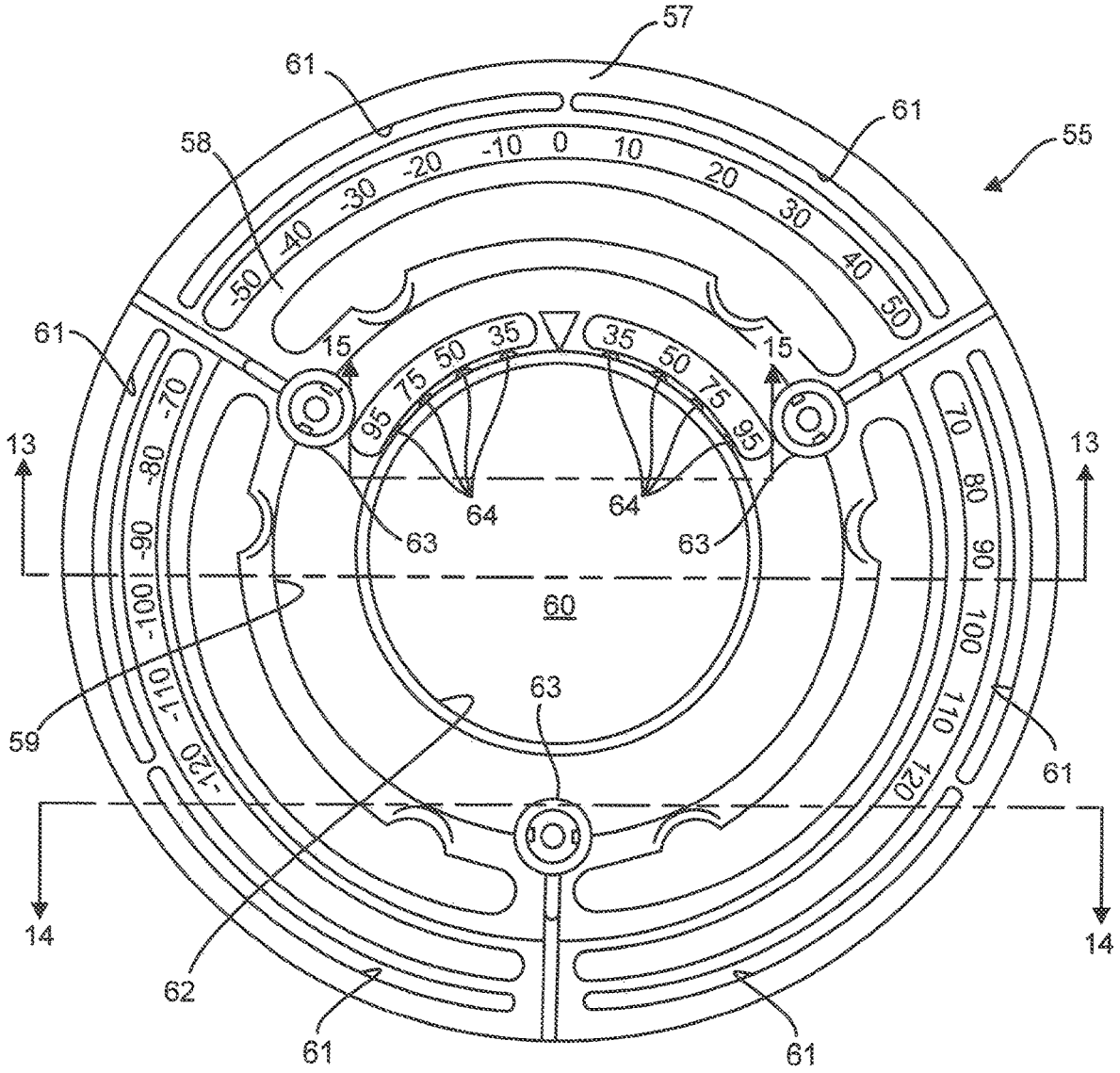
FIG. 12 is an end view in elevation of a control cage adapter for the twist-lock assembly.
Figure 13:
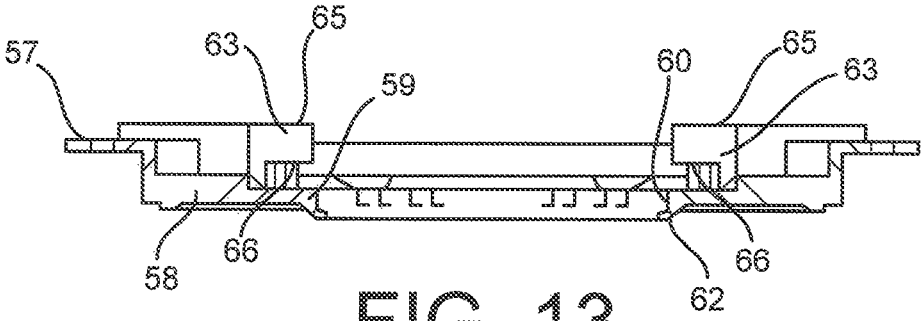
FIG. 13 is a sectional view of the control cage adapter taken along the line 13-13 in FIG. 12.
Figure 14:
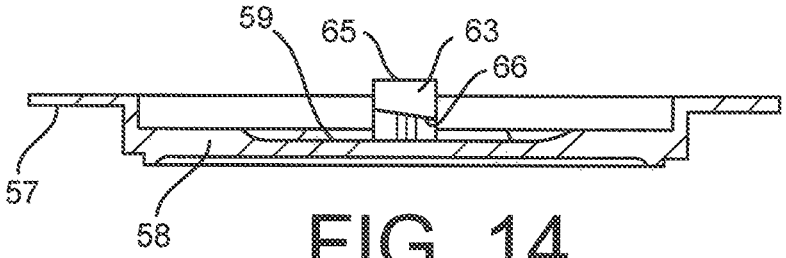
FIG. 14 is another sectional view of the control cage adapter taken along the line 14-14 in FIG. 12.
Figure 15:
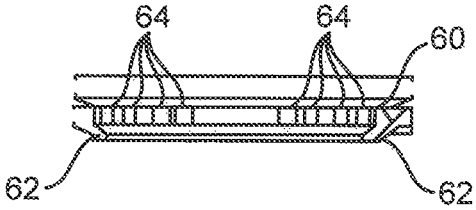
FIG. 15 is a partial sectional view looking radially outwardly and taken along the line 15-15 in FIG. 15 of a plurality of channels in the control cage adapter forming part of the alignment mechanism for the control cage.

As shown best in FIGS. 12, 15 and 16, control cage adapter 55 also includes an arrangement that cooperates with the tenons 33 formed in control cage 26 for properly aligning cage 26 within housing 13 so that discharge opening 25 faces upwardly, either vertically or at an acute angle to vertical, when cage 26 is re-assembled in its operative position within housing 13. More specifically, a plurality of circumferentially spaced mortises or channels 64 are formed in the inner circular edge 65 of inner ring member 58 formed by opening 60. Each mortise or channel 64 mirrors the shape and size of tenons 33. Thus, each channel 64 has a volume or profile which is in the form of one-half a cylinder, i.e. a cylinder which has been bisected by a plane extending longitudinally through its center, i.e. bisected perpendicular to the base of the cylinder. Thus, the shape or profile of each channel 64 is one-half of a cylinder, and that one-half being the longitudinally extending half of the cylinder. Thus, during assembly, the tenons 33 of control cage 26 are aligned with a pair of channels 64, and cage 26 is then slid axially through opening 60 of adapter 55 until tenons 33 are engaged or received within, and are in registry with, the desired pair of channels 64 so that discharge opening 25 in control cage 26 is in its desired upright location.

Figure 17:
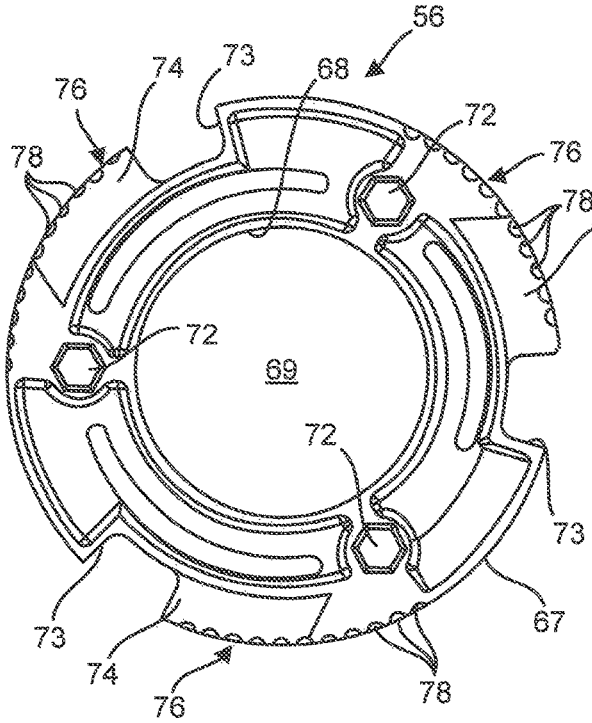
FIG. 17 is an end view in elevation looking at the front of a clamping plate for the twist-lock assembly.
Figure 19:
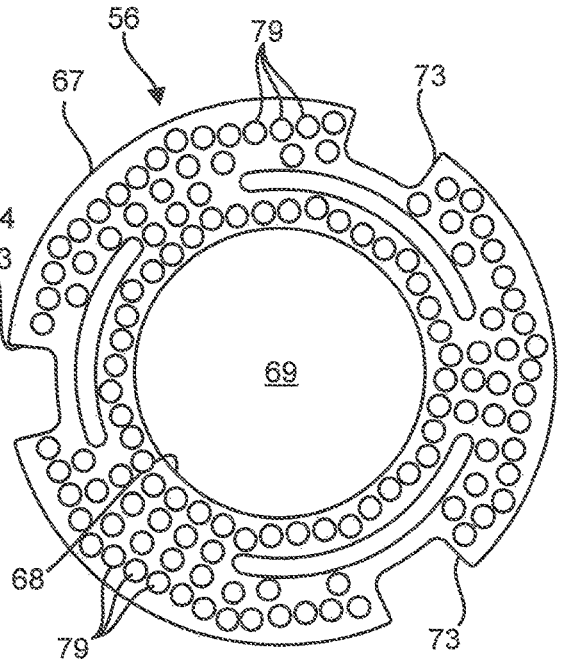
FIG. 19 is an end view in elevation looking at the rear of the clamping plate of FIG. 17.
Figure 18:
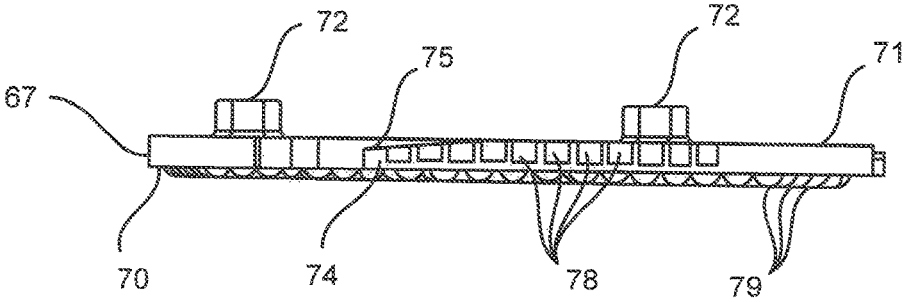
FIG. 18 is a side view in elevation of the clamping plate of FIG. 17.

Referring now to FIGS. 17-19, the clamping plate 56 is illustrated in more detail. Clamping plate 56 comprises a relatively thin, annular, disk-shaped body having a radially outer circumferential surface 67, and a radially inner circumferential surface 68 defining a central opening 69. Opening 69 is concentric with openings 14 and 15 in housing 13 and coaxial with rotational axis 12 when plate 56 is in its operative position on adapter 55. Opening 69 has a diameter less than the diameter of flange 43 of feed spout 23, but large enough to enable clamping plate 56 to be positioned about the body 38 of spout 23. Thus, clamping plate 56 cannot pass over flange 43 or rim 48. Plate 56 also has a relatively flat annular axial inner surface 70 and a relatively flat annular axial outer surface 71. Inner surface 70 has a series of dimples or half spheres 79 formed therein which help reduce friction when twisting or turning plate 56 on adapter 55, and also provide a release for any trapped shot blast media. Inner surface 70 abuts against and is engagable with the outer surface 44 of flange 43 when locking feed spout 23 and control cage 26 in their operative positions. A plurality of hexagonal-shaped knobs 72 project axially outwardly from outer surface 71, and are equi-angularly spaced 120 degrees apart from each other. Knobs 72 are shaped to accommodate the head of a wrench and provide leverage to a user for twisting or rotating plate 56 in a clockwise or in a counterclockwise direction. A plurality of notches 73 are formed in outer circumferential surface 67 of plate 56. Notches 73 extend both radially inwardly from outer circumferential surface 67 as well as circumferentially along surface 67 so as to have sufficient length and width dimensions to enable tabs 63 of adapter 55 to pass therethrough. A plurality of ramps 74 are formed along the outer circumferential surface 67 of plate 56. Each ramp 74 extends both radially inwardly from outer circumferential surface 67 as well as circumferentially along surface 67 so as to have sufficient radial depth to receive a projecting socket 63 of adapter 55, and to enable the tapered inner surface 66 of socket 63 to slide therealong over its inclined or sloped surface 75. Each surface 75 slopes gradually outwardly from a location adjacent the axial inner surface 70 of plate 56 to a location substantially flush with the axial outer surface 71 of plate 56, i.e. inclined upwardly at an angle of from about 1 degree to about 15 degrees, preferably about 5 degrees to about 10 degrees, as shown in FIG. 18. The tapered inner surfaces 66 of sockets 63 are likewise tapered or inclined at an angle of from about 1 degree to about 15 degrees, preferably about 5 degrees to about 19 degrees, in order to match the slope of surfaces 75.

Clamping plate 56 has scalloped edges 76 formed in and extending along the outer circumferential surface 67 of ramps 74. These scalloped edges 76 are formed by partial circular segments 78 which are in the form of one-half a blind bore. Segments 78 do not extend all the way through plate 56, but only part way from surface 71 to surface 70, as shown best in FIG. 18. Thus, each segment 78 has a volume or profile which is in the form of one-half a cylinder, i.e. a cylinder that has been bisected by a plane extending longitudinally through its center, i.e. bisected perpendicular to the base of the cylinder.

Figure 20:
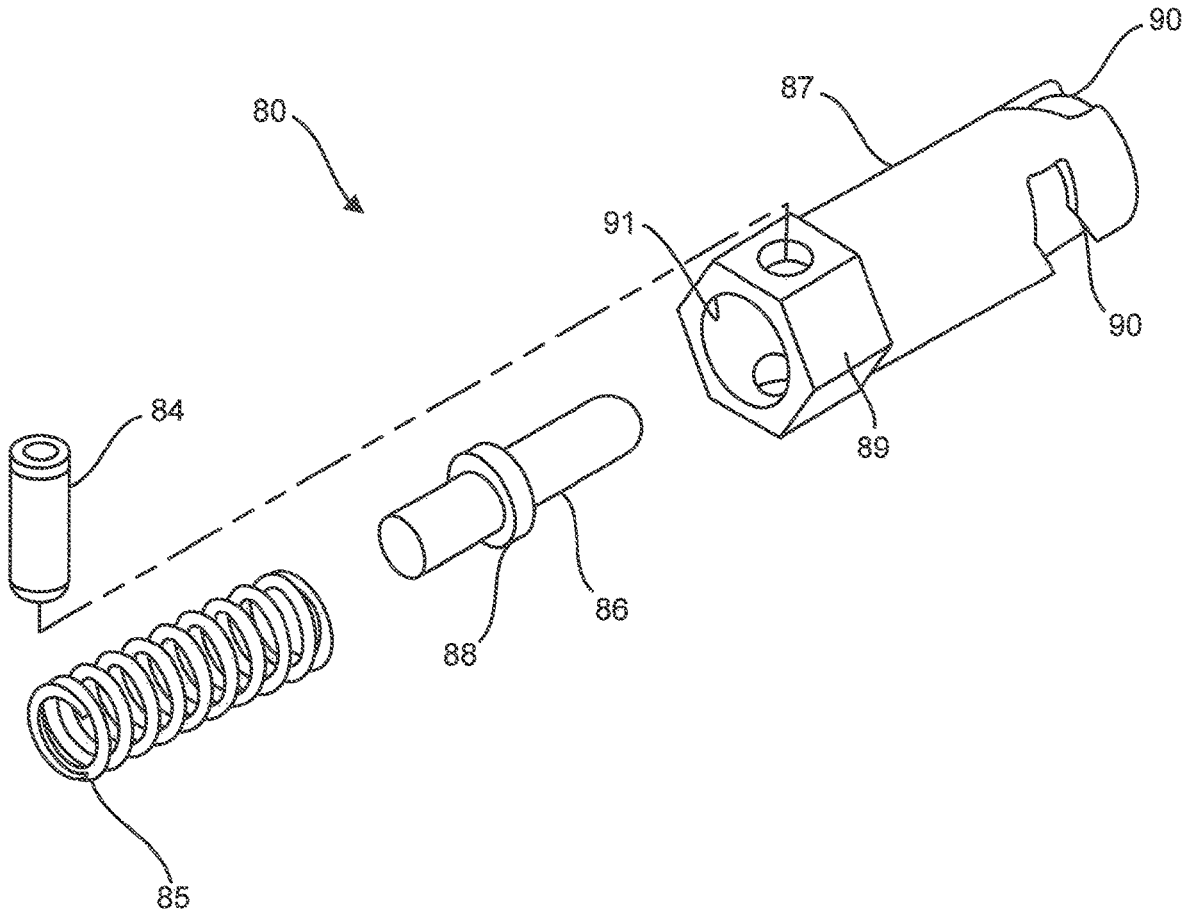
FIG. 20 is an exploded perspective view illustrating a locking pin assembly for holding the clamping plate in its locked position on the control cage adapter.

As shown best in FIG. 1, the diameter of plate 56 is substantially equal to the diameter of recess 59 formed in adapter 55 so that plate 56 nests within recess 59 during a locking operation. As such, and when desiring to lock feed spout 23 and control cage 26 in their operative positions, control cage 26 is first positioned within housing 13 around impeller 20 with its L-shaped rim 31 located at the access opening 15. Plate 56 is then positioned around the body 38 of feed spout 23 by being slid over the inlet end 39 of spout 23 with its inner surface 70 facing the outer surface 44 of flange 43. Then, plate 56 is positioned so that sockets 63 of adapter 55 are aligned with notches 73 in plate 56. Plate 56 is then moved axially inwardly so that sockets 63 pass through notches 73, and plate 56 nests within recess 59 of adapter 55. Plate 56 is then rotated in a clockwise direction forcing the tapered inner surfaces 66 of sockets 63 to slide along the inclined surfaces 75 of ramps 74, as shown in FIG. 20, to move plate 56 further axially inwardly to compress seal 52 on flange 43 of feed spout 23 against the L-shaped rim 31 of control cage 26, and in turn the rim 31 of cage 26 against the lip 62 of adapter 55 to thus lock the control cage 26 and feed spout 23 in their proper operational positions. The head of a wrench can then be engaged with one of the knobs 72, and a user applies torque thereto to move claping plate in a slightly further clockwise direction to thoroughly seat or lock the control cage 26 and feed spout 23 in their respective operative positions. The use of three or more equi-angularly spaced apart ramps 74 and sockets 63 provide an even and uniform circumferentially applied force or pressure on outer surface 44 of flange 43 of spout 23 and on rim 31 of cage 26 to insure proper assembly as well as proper sealing between the feed spout 23, control cage 26 and housing 13. In order to disassemble spout 23 and cage 26 from housing 13, the above procedure is simply reversed, and is initiated by first rotating or twisting plate 56 in a counterclockwise direction.

Referring now to FIGS. 20-23, a locking pin assembly 80 is illustrated for securely holding clamping plate 56 in its rotated and locking position. Locking pin assembly 80 prevents plate 56 from loosening or rotating on its own in a counterclockwise direction to an unlocked position. Locking pin assembly 80 includes a spring retention dowel 84, a compression spring 85 surrounding an engagement pin 86, and a cylindrical hollow locking pin body 87. The upper end of body 87 has a hexagonal-shaped head 89 adapted to receive a wrench to enable easy rotation of assembly 80. The lower end of body 87 has a pair of helical circumferential grooves 90 disposed 180 degrees apart and etched into its outer surface. These grooves 90 are cut in such a way that the spring 85 is compressed as the locking pin assembly 80 is rotated. The grooves 90 are cut to compress the spring 85 until the last ⅛ of rotation (approximately 22.5 degrees) where in the last ⅛ rotation the spring 85 is decompressed to push the pin 86 out of body 87 to hold the clamping plate 56 in position on the adapter 55.

Figure 21:
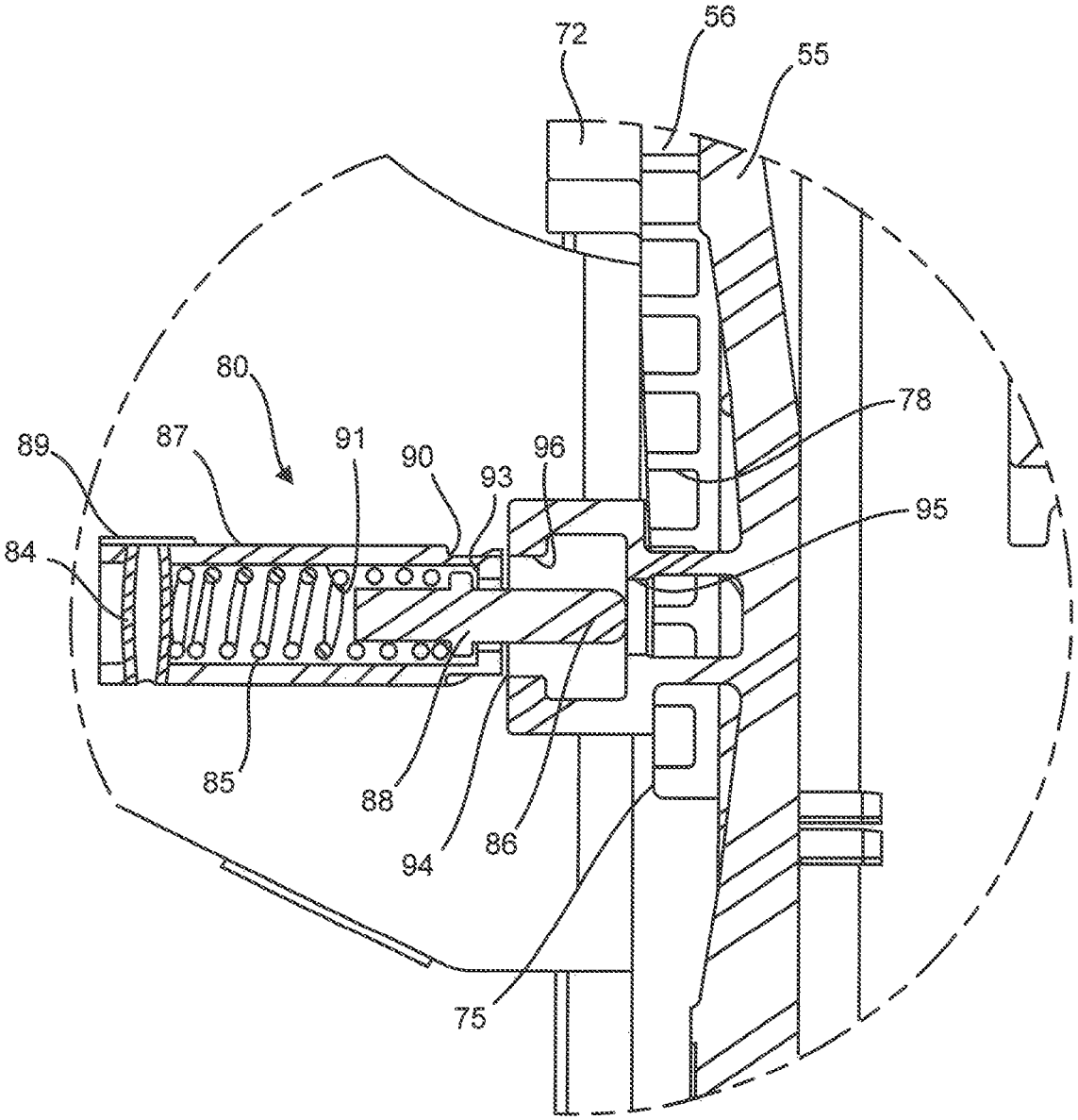
FIG. 21 is an enlarged partial sectional view illustrating a locking pin assembly for the clamping plate showing the locking pin assembly disengaged from the clamping plate and control cage adapter, and in its unlocked position.
Figure 22:
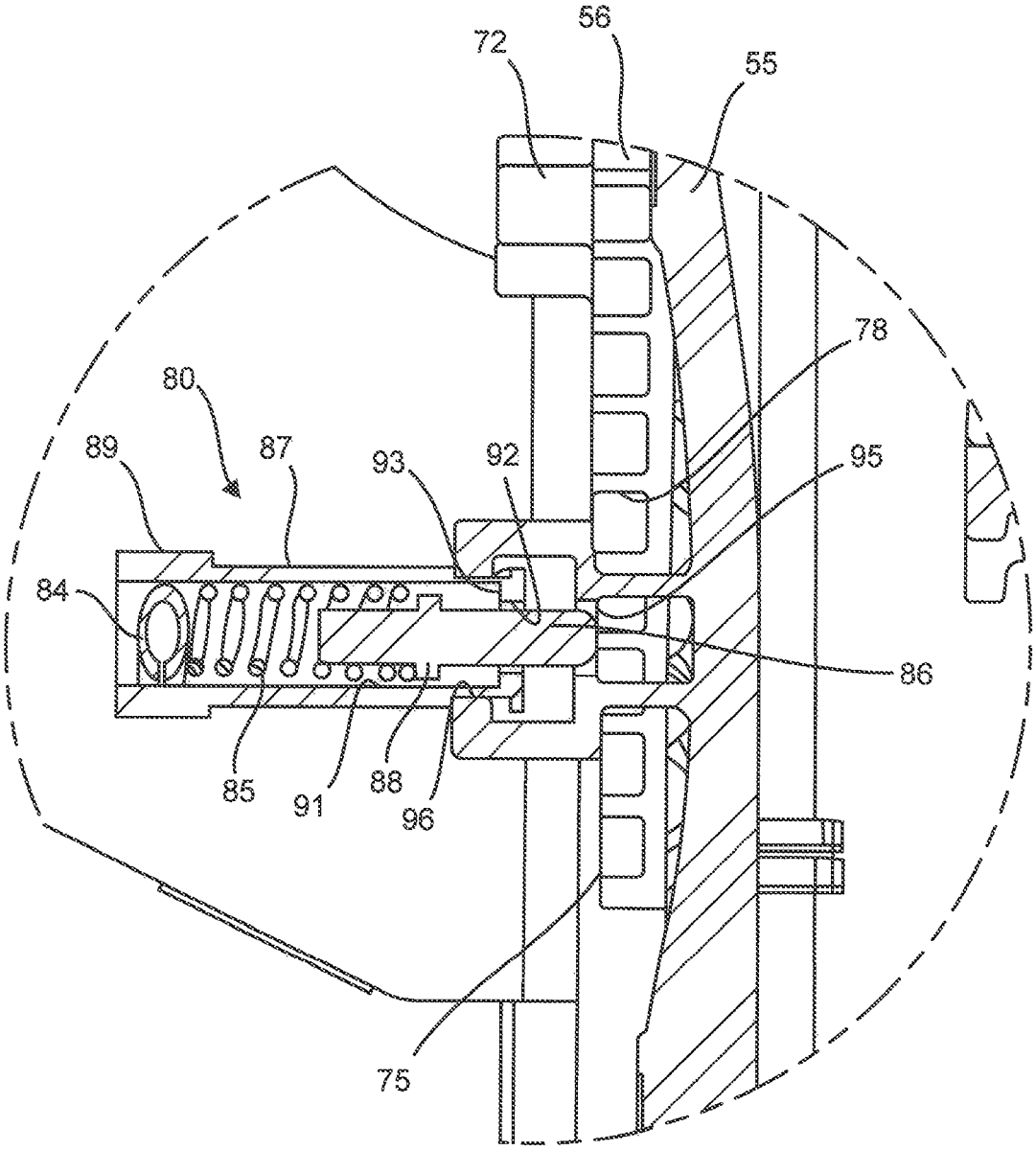
FIG. 22 is an enlarged partial sectional view similar to FIG. 21 illustrating the locking pin assembly engaged with the control cage adapter, but still in its unlocked position.
Figure 23:
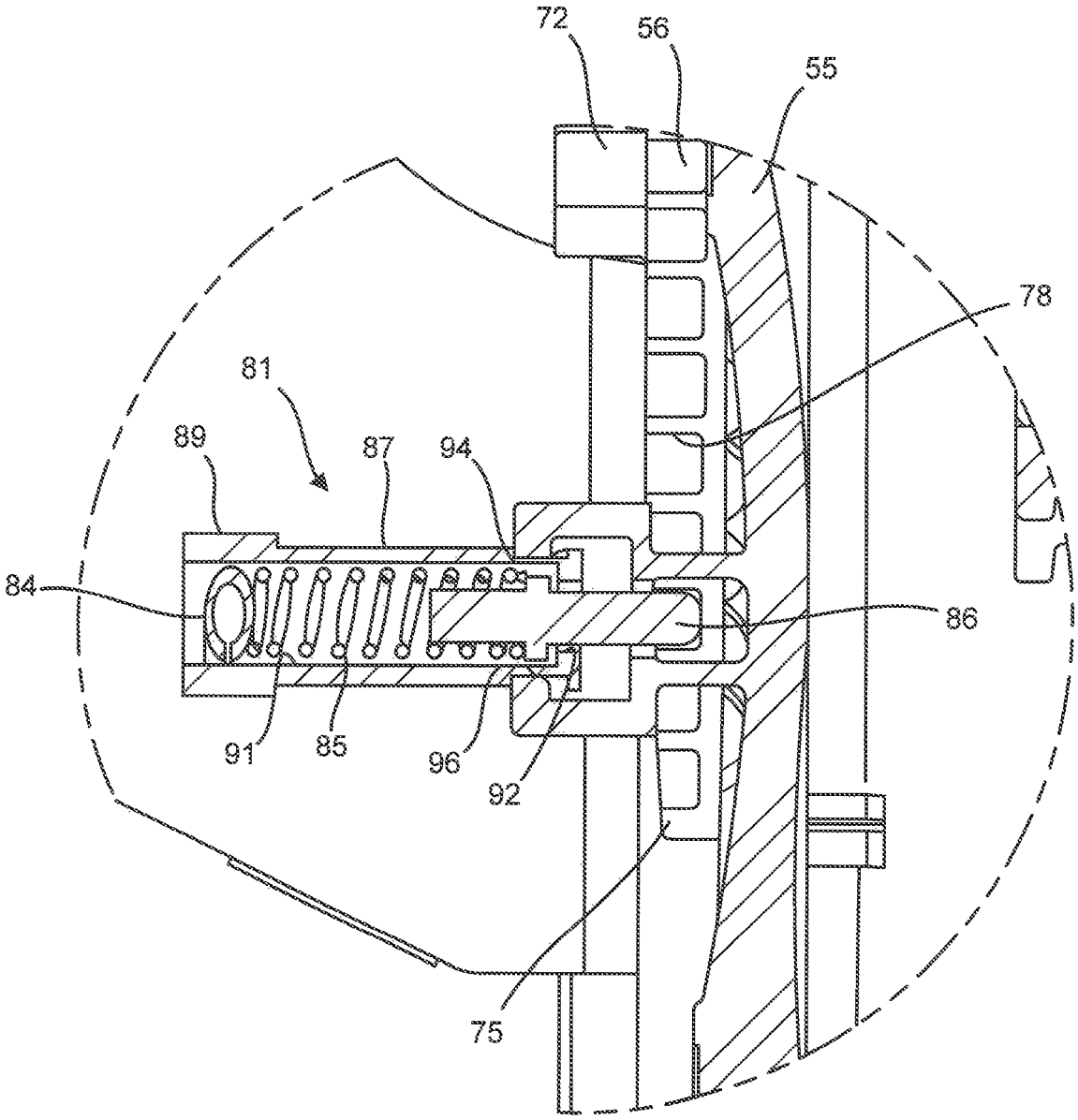
FIG. 23 is an enlarged partial sectional view similar to FIGS. 21 and 22 illustrating the locking pin assembly engaged with both the control cage adapter and the clamping plate and in its locked position to prevent rotation of the clamping plate.

As shown best in FIGS. 21-23, pin 86 is slidably received within the hollow central opening 91 of body 87 and is movable between a disengaged position or unlocked position (see FIGS. 21 and 22), and an engaged or locked position (see FIG. 23) that prevents rotational movement of clamping plate 56. One end of spring 85 abuts against a collar 88 formed on pin 86, and the opposite end of spring 85 abuts against dowel 84 so that spring 85 biases pin 86 in a direction to project from an opening 92 formed in the lower end of body 87. The diameter of opening 92 is less than the diameter of opening 91 which thus forms a stop surface 93 engageable by collar 88 to limit the sliding movement of pin 86.

As also shown best in FIGS. 21-23, each pin-receiving socket 63 is cylindrically-shaped having an upper opening 94 formed in its outer surface 65 sized to receive the lower end of body 87, and a lower opening 95 formed in tapered surface 66 sized to receive pin 86. The radially inner surface of upper opening 94 functions as a cam 96 that slides against the edges of grooves 90 in body 87 as assembly 80 is rotated to impart sliding movement to pin 86, as is illustrated in FIGS. 21-23 and as will hereinafter be described.

Initial operation of the locking pin assembly 80 is shown in FIG. 21. The locking pin assembly 80 is inserted into the locking pin socket 63 by aligning the lead edge of groove 90 with cam 96 of socket 63 of the control cage adapter 55. During initial assembly, the compression spring 85 is not compressed and collar 88 of pin 86 abuts against stop surface 93 of socket 63.

As the locking pin assembly 80 is rotated clockwise (see FIG. 22), the grooves 90 engage cam 96, and the tip of pin 86 contacts the surface 75 of ramp 74 of clamping plate 56. This action compresses spring 85 until the locking pin assembly 80 is fully seated in locking pin socket 63. At this point, spring 85 is at maximum compression.

Once the locking pin assembly 80 is fully seated in the locking pin socket 63, the clamping plate 56 is rotated clockwise. Rotating clamping plate 56 clockwise causes the spring 85 to push pin 86 to drop off of surface 75 into one of the semi-circular bores 78 located around the outside scalloped perimeter 76 of clamping plate 56. This action results in locking clamping plate 56 from any further rotation.

Figure 24:
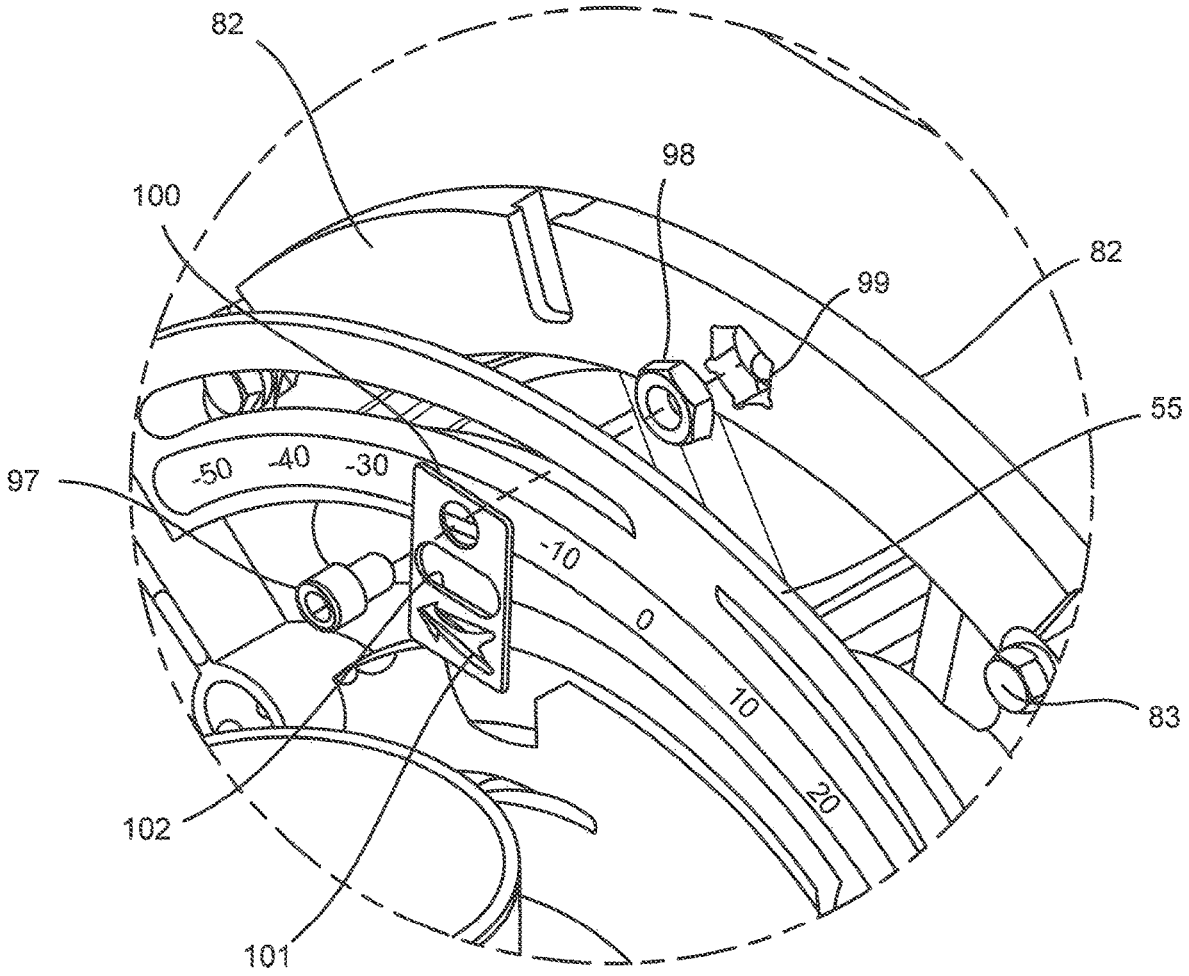
FIG. 24 is an enlarged exploded and perspective view of a fitting used to properly orientate the control cage adapter relative to the rotational centerline of the centrifugal blasting wheel.
Figure 25:
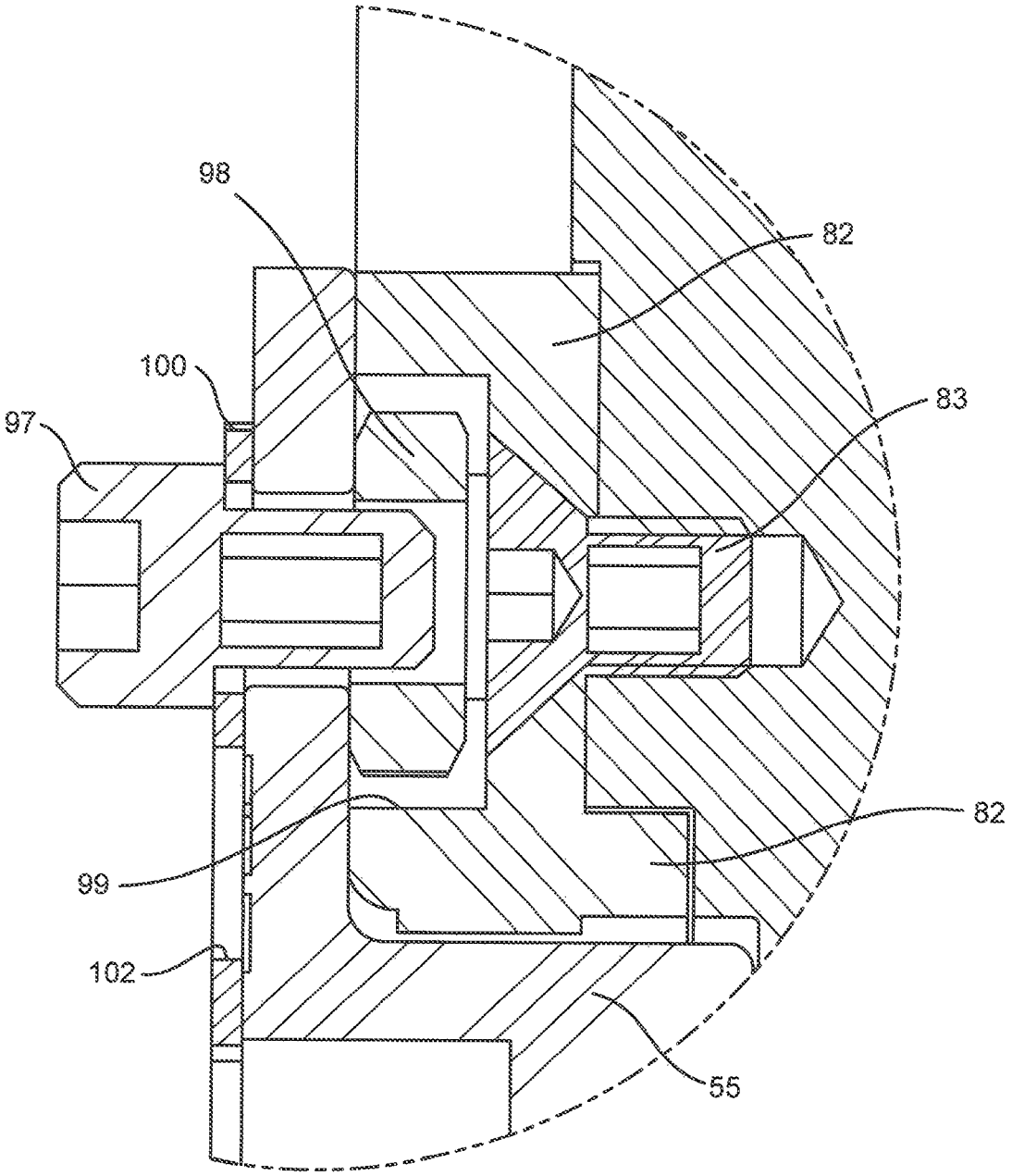
FIG. 25 is an enlarged cross sectional view illustrating the fitting of FIG. 24 in its assembled position.

Referring now to FIGS. 24 and 25, the blasting wheel assembly 10 also includes a mechanism for properly re-aligning the control cage adapter upon its removal from wheel assembly to ensure its correct orientation upon re-assembly. The alignment mechanism for the control cage adapter 55 includes a fastener 97, a fastener nut 98, a recess 99 formed in the face of mounting ring 82 shaped to capture and prevent rotation of nut 98, and a pattern and wheel direction indicator tag 100. The fastener nut 98 is inserted into recess 99 before control cage adapter 55 is installed on the blast wheel housing 13. Once the wheel rotation and control cage adapter position is set, the wheel direction indicator tag 100 and fastener 97 are affixed to fastener nut 98. Upon removal of the control cage adapter 55 from the mounting ring 82, the fastener 97, pattern and wheel direction tag 100, and fastener nut 98 are all removed along with the control cage adapter 55 as a unit. As there is only one recess 99 formed in mounting ring 82 shaped to capture the fastener nut 98 on the mounting ring 82, the control cage adapter 55 can only be installed in one position, ensuring the blast wheel is re-assembled with all components in the correct and original orientation. The arrow 101 on the pattern and wheel direction tag 100 serves as a visual indicator of the direction of shot wheel rotation. The cutout 102 on tag 100 in combination with the numbering on the face of control cage adapter 55 serves as a visual indicator of the orientation of the control cage adapter 55 relative to wheel centerline or axis of rotation 12.

The invention claimed is:

1. A centrifugal throwing wheel for propelling abrasive shot blast material against a workpiece, comprising:

(a) a housing having an access opening in a side wall thereof;

(b) a throwing wheel rotatable within said housing;

(c) a plurality of throwing blades disposed within said housing and removably coupled to said throwing wheel;

(d) a control cage disposed within said housing at said access opening in a stationary operative position relative to said throwing wheel, said control cage having a discharge opening formed therein with said discharge opening facing upwardly;

(e) an impeller within said housing coupled to said throwing wheel for rotation within said control cage;

(f) a feed spout disposed at said access opening of said housing, said feed spout having a shot-receiving inlet end and a shot-discharging exit end aligned with said impeller for delivering blasting shot to said impeller; and (g) a twist-lock assembly for locking and unlocking said feed spout and control cage in their respective operative positions, said twist-lock assembly comprising:

(i) a fixed annular control cage adapter mounted on the side wall of said housing at said access opening, said annular control cage adapter having a circular lip formed around a central opening concentric with the access opening in said housing;

(ii) an annular clamping plate surrounding the shot discharging exit end of said feed spout, said clamping plate having an inner surface facing said control cage adapter and an outer surface facing said feed spout, and including a plurality of circumferentially spaced blind bores formed in said outer surface, said clamping plate rotatable with respect to said control cage adapter for locking said control cage and said feed spout to said control cage adapter in their respective operative positions in response to rotation thereof in one direction to a locking position and for unlocking said control cage and feed spout from said control cage adapter in response to rotation thereof in an opposite direction to an unlocking position to permit change out of said control cage and said feed spout without removal of said control cage adapter;

(iii) an alignment mechanism to orientate the control cage within the housing in one of a plurality of positions to insure the discharge opening of the control cage faces upwardly, either vertically or at an acute angle to vertical, said alignment mechanism comprising a pair of circumferentially spaced tenons projecting from said control cage and a corresponding plurality of circumferentially spaced mortises formed in the circular lip of said control cage adapter receiving said tenons and orienting said control cage with respect to said control cage adapter in a stationary operative position with said discharge opening facing upwardly; and (iv) a locking pin assembly mounted on the control cage adapter and cooperating between the control cage adapter and the clamping plate to securely holding the clamping plate in a rotated and locking position, said locking pin assembly comprising a pin movable between an unlocked position disengaged from a blind bore of the plurality of circumferentially spaced blind bores of said clamping plate to permit rotation of the clamping plate and a locked position engaged with the blind bore of said clamping plate to prevent rotation of the clamping plate.

2. The centrifugal throwing wheel of claim 1 wherein one of said control cage adapter or said clamping plate includes at least one ramp having an inclined surface disposed thereon, and the other of said control cage adapter or said clamping plate includes at least one socket having a tapered surface disposed thereon which is engagable with said at least one ramp so that rotation of said clamping plate to said locking position moves the tapered surface of said at least one socket along the inclined surface of said at least one ramp to cause said clamping plate to lock said control cage and feed spout in their operative positions.

3. The centrifugal throwing wheel of claim 2 wherein said at least one ramp is disposed on said clamping plate and said at least one socket is disposed on said control cage adapter.

4. The centrifugal throwing wheel of claim 3 wherein said at least one ramp of said clamping plate comprises a plurality of equi-angularly spaced apart ramps, and said control cage adapter has an equal number of equi-angularly spaced apart sockets.

5. A centrifugal throwing wheel for propelling abrasive shot blast material against a workpiece, comprising:

(a) a housing having a driveshaft-receiving opening in one side wall thereof and an access opening in an opposite side wall thereof which is disposed concentrically with said driveshaft-receiving opening;

(b) a driveshaft disposed at said driveshaft-receiving opening, said driveshaft having an inner end and an outer end, said inner end connected to a source of power for rotating said driveshaft along an axis of rotation which is disposed concentrically with said driveshaft-receiving opening and said access opening;

(c) a throwing wheel rotatable within said housing and connected to the outer end of said driveshaft for coaxial rotation therewith;

(d) a plurality of throwing blades disposed within said housing and removably coupled to said throwing wheel;

(e) a hub disposed within said housing and affixed to said throwing wheel for coaxial rotation therewith;

(f) a cylindrically shaped control cage concentrically aligned with said drive shaft and disposed within said housing at said access opening in a stationary operative position relative to said throwing wheel and said hub, said control cage having an axial inner end disposed adjacent said hub, an axial outer end having an L-shaped rim disposed adjacent said access opening, and an upwardly facing and axially extending discharge opening for delivering blasting shot to said throwing blades;

(g) a cylindrically-shaped impeller coupled to said hub for rotation within said control cage;

(h) a feed spout disposed at the access opening of said housing, said feed spout having a shot-receiving inlet end and a shot-discharging exit end, said shot-discharging exit end having an annular flange extending therefrom and a feed opening aligned with said impeller for delivering blasting shot to said impeller; and (i) a twist-lock assembly for locking and unlocking said feed spout and said control cage in their respective operative positions, said twist-lock assembly comprising:

(1) a fixed annular control cage adapter mounted on said opposite side wall of said housing, said control cage adapter having a central opening concentric with said axis of rotation and defining a radially inwardly projecting annular lip;

(2) an annular clamping plate surrounding the shot-discharge exit end of said feed spout, said clamping plate having an inner surface facing said control cage adapter and an outer surface facing said feed spout, and including a plurality of circumferentially spaced blind bores formed in said outer surface, said clamping plate rotatable with respect to said control cage adapter and said feed spout in one direction to engage the annular flange of said feed spout with the rim of said control cage and the rim of said control cage with the annular lip of said control cage adapter to lock said control cage and said feed spout to said control cage adapter in their respective operative positions and for unlocking said control cage and feed spout from said control cage adapter in response to rotation thereof in an opposite direction to permit change-out of said control cage and said feed spout without removal of said control cage adapter;

(3) at least one ramp having an inclined surface disposed on one of said control cage adapter or said clamping plate;

(4) at least one socket having a tapered surface disposed on the other of said control cage adapter or said clamping plate, whereby rotation of said clamping plate in one direction moves the tapered surface of said at least one socket against and along the inclined surface of said at least one ramp to cause said clamping plate to move axially inwardly to force the flange of said feed spout and the axial outer end of said control cage against the lip of said control cage adapter to thereby lock said feed spout and control cage in their respective operative positions;

(5) an alignment mechanism to orientate the control cage within the housing in one of a plurality of positions to insure the discharge opening of the control cage faces upwardly, either vertically or at an acute angle to vertical, said alignment mechanism comprising a pair of circumferentially spaced tenons projecting from said control cage and a corresponding plurality of circumferentially spaced mortises formed in the circular lip of said control cage adapter receiving said tenons and orientating said control cage with respect to said control cage adapter in an operative stationary position with said discharge opening facing upwardly; and (6) a locking pin assembly mounted on the control cage adapter and cooperating between the control cage adapter and the clamping plate to securely hold the clamping plate in a rotated and locking position, said locking pin assembly comprising a pin movable between an unlocked position disengaged from a blind bore of the plurality of circumferentially spaced blind bores of said clamping plate to permit rotation of the clamping plate and a locked position engaged with the blind bore of said clamping plate to prevent rotation of the clamping plate.

6. The centrifugal throwing wheel of claim 5 wherein said at least one ramp is disposed on said clamping plate and said at least one socket is disposed on said control cage adapter.

7. The centrifugal throwing wheel of claim 6 wherein said at least one ramp is arcuate-shaped.

8. The centrifugal throwing wheel of claim 7 wherein said annular clamping plate has a circumferential outer edge and said at least one ramp is disposed at the circumferential outer edge of said clamping plate.

9. The centrifugal throwing wheel of claim 8 wherein said clamping plate has a radially extending inner surface facing the access opening in said housing and an opposite radially extending outer surface, and the inclined surface of said at least one ramp slopes from a point adjacent said inner surface axially outwardly toward said outer surface.

10. The centrifugal throwing wheel of claim 9 wherein said clamping plate includes at least one knob projecting from the outer surface of said clamping plate to aid in rotating said clamping plate.

11. The centrifugal throwing wheel of claim 9 wherein said at least one ramp of said clamping plate comprises a plurality of equi-angularly spaced ramps disposed circumferentially about said outer edge.

12. The centrifugal throwing wheel of claim 11 wherein said at least one socket of said control cage adapter comprises a plurality of equi-angularly spaced sockets disposed circumferentially thereon for engaging said plurality of ramps.

13. The centrifugal throwing wheel of claim 8 wherein said clamping plate includes the circumferential outer edge and said plurality of blind bores form a scallop-shaped segment therein at the location of said at least one ramp.

14. The centrifugal throwing wheel of claim 13 further including a spring biasing said locking pin to a locking position wherein said pin is received within one of said blind bores of said scalloped-shaped segment to lock said clamping plate in position and prevent rotation thereof.

15. The centrifugal throwing wheel of claim 6 wherein said control cage adapter has a central recess formed therein and said clamping plate nests within said central recess.

16. The centrifugal throwing wheel of claim 15 wherein the inner surface of said clamping plate has a plurality of dimples formed therein.

* * * * *